US006582206B2

(12) United States Patent
Schluecker

(10) Patent No.: US 6,582,206 B2
(45) Date of Patent: Jun. 24, 2003

(54) DIAPHRAGM CHUCKING WITH ELASTICITY ADJUSTMENT

(75) Inventor: Eberhard Schluecker, Obersulm/Willsbach (DE)

(73) Assignee: Lewa Herbert Ott GmbH + Co., Leonberg (DE)

( * ) Notice: Subject to any disclaimer, the term of this patent is extended or adjusted under 35 U.S.C. 154(b) by 2 days.

(21) Appl. No.: 09/808,108

(22) Filed: Mar. 15, 2001

(65) Prior Publication Data

US 2001/0043872 A1 Nov. 22, 2001

(30) Foreign Application Priority Data

Mar. 16, 2000 (DE) ..... 100 12 904

(51) Int. Cl.[7] ..... F04B 43/06

(52) U.S. Cl. ..... 417/395; 417/383; 92/96; 92/104

(58) Field of Search ..... 417/383, 395, 417/571; 92/96, 98 R, 101, 104

(56) References Cited

U.S. PATENT DOCUMENTS 2,242,582 A * 5/1941 Jencick ..... 417/311
4,275,997 A * 6/1981 Woodring et al. ..... 417/218
4,430,048 A * 2/1984 Fritsch ..... 417/383
4,741,360 A * 5/1988 Affeldt et al. ..... 137/510
4,760,690 A * 8/1988 Lang et al. ..... 57/243
4,781,535 A * 11/1988 Frawley et al. ..... 417/53
4,862,731 A * 9/1989 Gates ..... 73/40.7
5,188,515 A * 2/1993 Horn ..... 417/63
5,217,797 A * 6/1993 Knox et al. ..... 92/103
5,279,504 A * 1/1994 Williams ..... 417/395
5,438,913 A * 8/1995 Budde ..... 92/98 R
5,560,279 A * 10/1996 Connors et al. ..... 92/5 R
5,860,793 A * 1/1999 Muscarella et al. ..... 417/388
6,126,403 A * 10/2000 Yamada ..... 417/46
6,173,959 B1 * 1/2001 Oikawa et al. ..... 277/312

* cited by examiner

*Primary Examiner*—Charles G. Freay
*Assistant Examiner*—John F. Belena
(74) *Attorney, Agent, or Firm*—Jacobson Holman PLLC

(57) ABSTRACT

A diaphragm pump with hydraulically powered diaphragm that is so chucked on a circulating rim between a pump lid and a pump housing in a predetermined radial chucking area and with a predetermined press-on force between the pump lid and the pump housing that the press-on force will be below a flow limit of the diaphragm material. At least one elastic part is provided additionally in the chucking area. That part is so designed that it will elastically compensate for any reductions occurring during the operation of the diaphragm pump in the press-on pressure in the chucking area of the diaphragm between the pump lid and the pump housing.

6 Claims, 3 Drawing Sheets

DIAPHRAGM CHUCKING WITH ELASTICITY ADJUSTMENT

FIELD OF THE INVENTION

This invention relates to a diaphragm pump with a hydraulically powered diaphragm.

BACKGROUND OF THE INVENTION

Growing environmental protection requirements, combined with strict legal requirements, can be met mostly only with the help of hermetically sealed process systems. Non-leaking fluid machines such as, for example, pumps and condensers, are of the utmost importance in this connection. Diaphragm pumps constitute an optimum solution, especially for delivering toxic, hazardous, annoying, sensitive, abrasive, corrosive fluids as well as for aseptic conditions. The diaphragm, as the central element, performs the double function of static seal and displacers in the form of an elastic delivery chamber wall. The static diaphragm seal is the basis for the hermetic tightness of diaphragm pumps. The diaphragm furthermore transmits the oscillating stroke motion of a drive through the fluid that is to be delivered, as a result of which, it is not only the pulsating delivery that materializes, but there is also an interaction with the fluid masses in the pipeline system. In the case of diaphragm pumps with hydraulic diaphragm drive, the oscillating motion of a drive member is transmitted via a hydraulic seal—which comprises a hydraulic fluid—to the diaphragm. The hydraulically driven diaphragm always works with balanced pressure and need withstand only deflection stresses.

PTFE (polytetrafluoroethylene) proved effective in diaphragm pump engineering due to its outstanding chemical stability and the good physical properties so that it became the standard material for diaphragms. Customary diaphragm designs are pure PTFE diaphragms with rotationally symmetrical shaft contour or flat contour and PTFE as protective layer on elastomer diaphragms.

The limit for the use of PTFE as diaphragm for diaphragm pumps currently is found at a delivery pressure of 350 bar and a temperature of 150° C. The reasons for these limitations are found in the cold-flow resistance that is no longer adequate and the tight sealing pressure of the PTFE in the diaphragm chucking. By means of design measures, for example, by means of a suitable ribbed structure, it has been possible to counteract the cold flow within limits. The ribbing prevents the diaphragm material from flowing out of the diaphragm chucking. As a result, one can raise the flow limit in the diaphragm chucking to values that are far above the yield stress from the tensile test.

Above 350 bar, there is also the fact that the parts between which the diaphragms are chucked, that is to say, the pump as such and the chuck drive housing are deformed by the change of pressure in the pump, which results in a certain "respiration" in the chucking. This term "respiration" refers to a decrease of the press-on pressure between the pump lid and the pump housing in the chucking area of the diaphragm, a decrease that keeps recurring possibly periodically during the operation of the diaphragm pump. The respiration increases with increasing pressure and growing structural size. The potential for elasticity adjustment by way of the diaphragm, however, is very limited so that this likewise creates a limit for any increases in the pressure and the structural size. Furthermore, the constantly recurring stress change of the diaphragm due to respiration constitutes a severe mechanical stress or dynamic alternating stress and after a corresponding span of time leads to the fatigue of the diaphragm material and finally to a destruction of the diaphragm. This action mechanism has so far not been recognized in this form.

SUMMARY OF THE INVENTION

The object of the invention therefore is to provide a diaphragm pump of the kind mentioned above, which eliminates the above-mentioned disadvantages and which can be used also at higher delivery pressures and higher operating temperatures with a long diaphragm service life. At the same time, the idea is to counteract the negative effect of "respiration" of the pump head in the area of the diaphragm chucking.

In the invention-based diaphragm pump, there is provided in the chucking area additionally at least one elastic part that is so designed that it will elastically adjust any reductions occurring during the operation of the diaphragm pump in the press-on pressure in the chucking area of the diaphragm between the pump lid and the pump housing.

This design offers the following advantage: the diaphragm pump is suitable also for high pressure, for example, above 350 bar, and for higher temperatures, for example, over 150° C. because deformations of pump lid and pump housing occurring in this area and possibly leading to a decline in the press-on pressure in the chucking area are effectively compensated. At the same time, a cold flow strength and tight sealing pressure of the diaphragm material that under certain operating conditions might possibly no longer be sufficient is also compensated. In other words, the invention-based arrangement increases the elasticity of the diaphragm in the chucking area so that the minimum pressure required for a tight seal is preserved in the chucking area of the diaphragm also in case of deformation of the parts that are involved in the chucking area. The elastic part that is provided according to the invention does not have any sealing function here; instead, it serves for the compensation of fluctuations in the press-on pressure in the chucking area of the diaphragm.

The elasticity reserves of a diaphragm packet are increased by virtue of the fact that the diaphragm comprises two or more material layers with at least one elastic part being arranged between at least two layers. Here, the elastic part, for example, is made as an elastic intermediate layer or as elastic intermediate ring.

The elastic part is advantageously made as a weft in order to ensure a fluid-conducting connection between the internal chamber between the two material layers of the diaphragm and a diaphragm rupture sensor.

The elastic part extends over the entire circumference of the diaphragm so as to compensate for any material deformations over the entire chucking area within the direction of circumference.

The elastic part can be arranged on one side or on both sides of the diaphragm.

In a preferred embodiment, the elastic part comprises one or several elastomer O-rings. As an alternative, the elastic part is made as a lip seal.

The elastic part is an integral part of the diaphragm for simple and quick assembly.

In a practical manner, the diaphragm is made of PTFE or PE or, as an alternative, it is made of an elastomer with a protective layer consisting of PTFE.

BRIEF DESCRIPTION OF THE DRAWINGS

The invention will be explained in greater detail below with reference to the drawings.

DETAILED DESCRIPTION OF THE PREFERRED EMBODIMENTS

Figure 1:
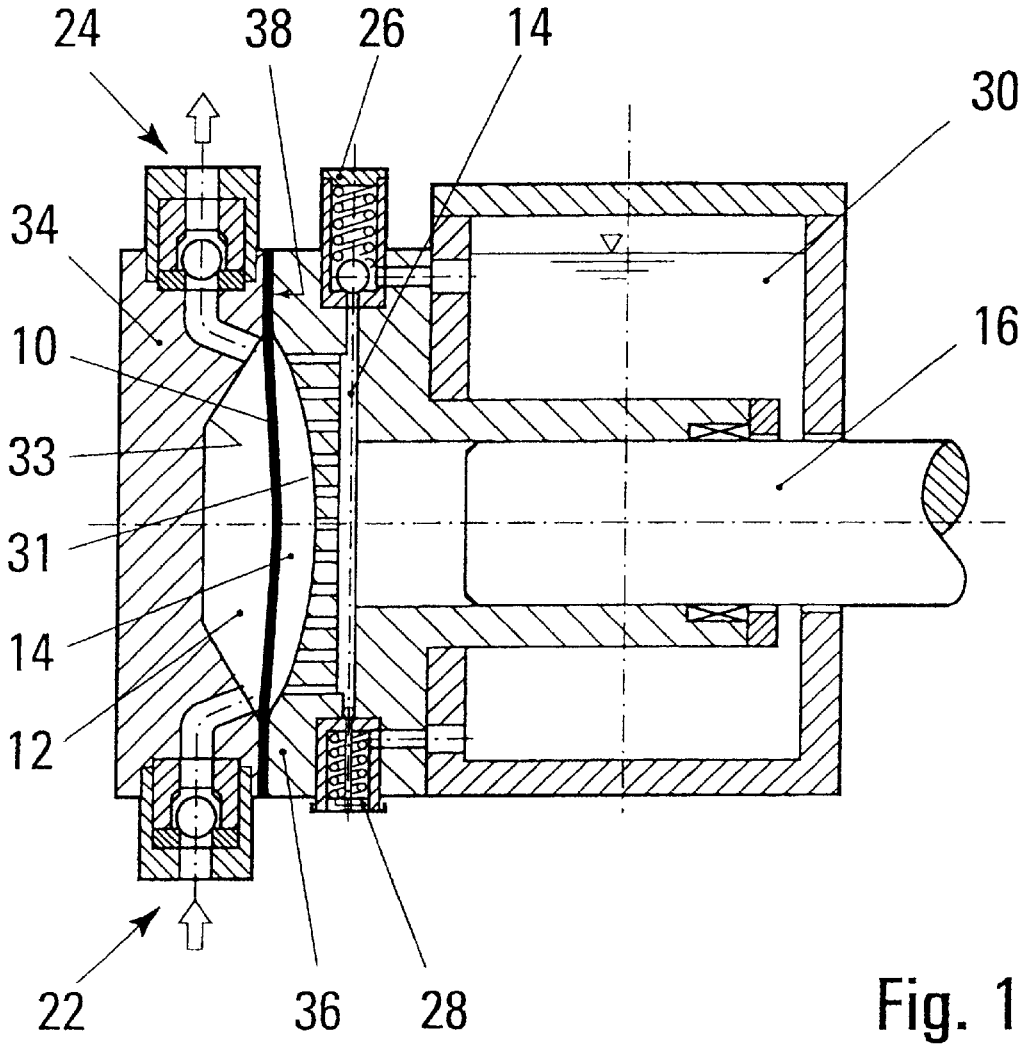
FIG. 1 shows a profile of a diaphragm pump.

As one can see in FIG. 1, the illustrated diaphragm pump comprises a diaphragm 10 that separates a delivery chamber 12 from a hydraulic chamber 14. As a drive, there is provided a piston 16 which, when in operation, oscillates around a constant central position of the piston. By way of example, piston 16 is shown in the position of the central piston position. The oscillating motion of piston 16 is transmitted via a hydraulic fluid in hydraulic chamber 14 to diaphragm 10, which performs a corresponding oscillating motion around a central position. In this way, fluid is suctioned from a suction side 22 of the diaphragm pump and is discharged again on a delivery side 24. Hydraulic chambers 14 are connected with a hydraulic storage chamber 30 via a pressure-limiting overpressure valve 26 and a refill valve 28 made as a flow valve. Furthermore, supporting surfaces 31, 33 are provided, laterally delimiting a work chamber of diaphragm 10. Here, the number 31 designates the supporting surface on the side of the hydraulic portion and the number 33 refers to the supporting surface on the side of the delivery chamber.

Diaphragm 10 is chucked between a pump lid 34 and a pump housing 36 in a predetermined radial chucking area 38 and is preferably supported by rib structures in the pump parts 34 and 36. In addition to diaphragm 10, an elastic element 40 is arranged in chucking area 38, as one can see, for example, in FIGS. 2 to 5. This elastic element 40 compensates for "respiration" in chucking area 38 at every point in time and ensures the pressure required for a tight seal. As a result, even at high pressure and temperature stresses going beyond the permissible stresses of known diaphragm pumps, one can ensure adequate surface area pressure of the diaphragm chucking 38.

The diaphragm chucking 38, designed according to the invention, thus comprises an elasticity compensation because the elastic part 40 is provided in chucking area 38 of diaphragm 10.

Figure 2:
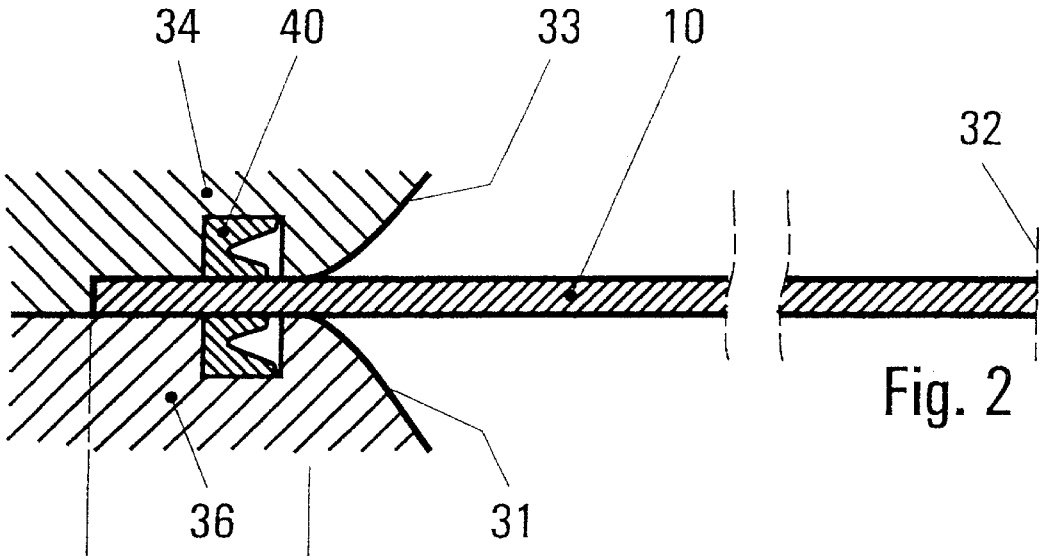
FIG. 2 shows a detailed profile view of a first embodiment of the invention-based elastic part.

In the first embodiment shown in FIG. 2, the elastic part 40 is made as a lip ring that is arranged on one side or, as shown in FIG. 2, on both sides of diaphragm 10 in chucking area 38.

Figure 3:
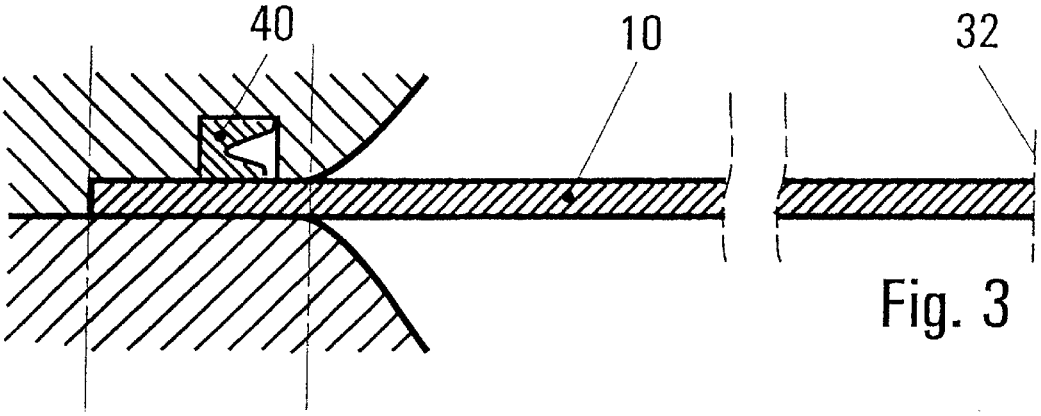
FIG. 3 shows a second embodiment of the elastic part.

In the modified embodiment according to FIG. 3, a lip ring of elastic part 40 is made in one piece with diaphragm 10 so that upon insertion of diaphragm 10, the elastic part 40 will automatically be arranged and mounted in chucking area 38.

Figure 4:
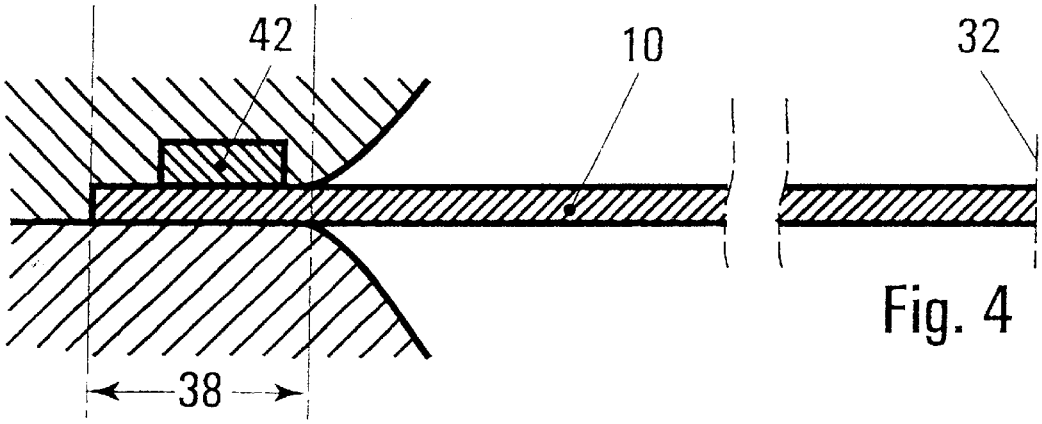
FIG. 4 shows a third embodiment of the elastic part.

In the other embodiment according to FIG. 4, the elastic part is made as an elastomer O-ring 42 and is arranged around the entire circumference in chucking area 38.

Figure 5:
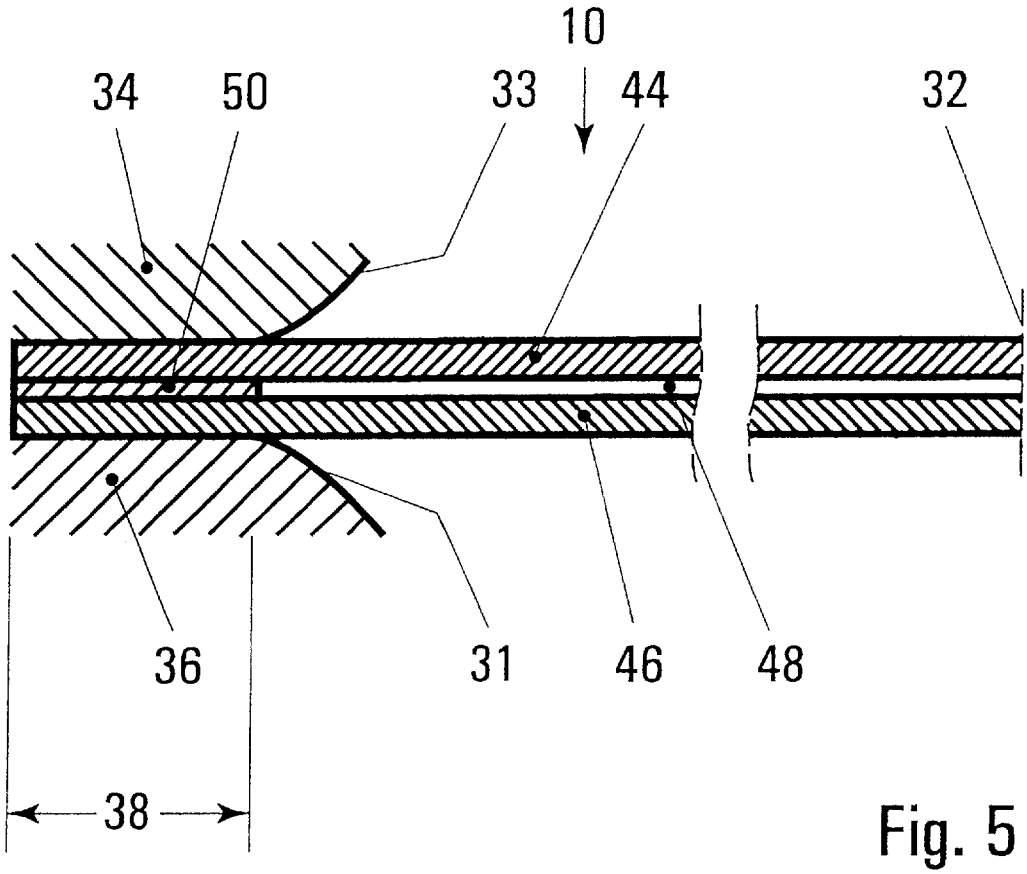
FIG. 5 shows a fourth embodiment of the elastic part.

In the embodiment according to FIG. 5, diaphragm 10 has two material layers 44, 46 between which there is a space 48 that, for example, is in fluid-conducting connection with a diaphragm rupture sensor, not shown. The elastic part here is made as intermediate ring or intermediate layer 50 and is arranged in chucking area 38 between material layers 44, 46 of diaphragm 10. In this way, diaphragm 10, so to speak, is positioned in a "floating" manner. The elasticity reserve of the diaphragm packet layers 44, 46 is increased as a result and the required minimum pressure is preserved in the chucking area even in case of any possibly occurring part deformations. In order to ensure the fluid-conducting connection between space 48 and a possibly present diaphragm rupture sensor, the intermediate ring or intermediate layer 50 is made as a weft. The diaphragm rupture sensor then records the fluid that enters the space 48 as a result of the diaphragm rupture, which fluid then penetrates through the gaps in the weft all the way to the diaphragm rupture sensor.

In FIGS. 2–5, the number 32 refers to the middle of diaphragm 10, which at the same time can be considered as the rotationally symmetrical axis.

The elastic part can also be made in the shape of at least one or several axially acting profile rings to achieve the desired elasticity adjustment.

I claim:

1. Diaphragm pump comprising:

a hydraulic power source, a single layer diaphragm hydraulically powered by said hydraulic power source and chucked at a circulating rim between a pump lid and a pump housing in a predetermined radial chucking area and with a predetermined press-on force between the pump lid and the pump housing so that the press-on force will be below the flow limit of the diaphragm material, and in the chucking area, only one elastic part in a shape of only one axially acting profile ring located between said diaphragm and said pump lid for achieving a desired elasticity adjustment that elastically compensates for any reductions occurring during the operation of the diaphragm pump in the press-on force in the chucking area of the diaphragm between the pump lid and the pump housing, the elastic part being a lip seal.

2. Diaphragm pump according to claim 1, wherein the elastic part extends in a circumferential direction over an entire circumference of the diaphragm.

3. Diaphragm pump according to claim 1, wherein the elastic part is made as an integral part of the diaphragm.

4. Diaphragm pump according to claim 1, wherein the diaphragm is made of PTFE or PE.

5. Diaphragm pump according to claim 1, wherein the diaphragm includes a protective layer consisting of PTFE.

6. Diaphragm pump according to claim 1, wherein said one elastic part is spaced radially inwardly from an outermost edge of the diaphragm.

* * * * *